US007040743B2

(12) United States Patent
Acosta et al.

(10) Patent No.: US 7,040,743 B2
(45) Date of Patent: May 9, 2006

(54) REGULATION OF BACK PRESSURE WITHIN AN INK RESERVOIR

(75) Inventors: Miguel A. Acosta, Aguadilla, PR (US); William Caro, Aguada, PR (US); Lester Ortiz, Camuy, PR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 73 days.

(21) Appl. No.: 10/423,360

(22) Filed: Apr. 25, 2003

(65) Prior Publication Data

US 2004/0223037 A1 Nov. 11, 2004

(51) Int. Cl.
*B41J 2/175* (2006.01)

(52) U.S. Cl. ..... 347/86

(58) Field of Classification Search ..... 347/84–87, 347/92

See application file for complete search history.

(56) References Cited

U.S. PATENT DOCUMENTS 4,771,295 A 9/1988 Baker et al.
5,047,790 A 9/1991 Cowger et al.
5,751,300 A 5/1998 Cowger et al.
5,808,643 A * 9/1998 Tracy et al. ..... 347/92
5,844,577 A 12/1998 Pawlowski, Jr.
6,302,530 B1 * 10/2001 Shimada et al. ..... 347/86
6,431,698 B1 * 8/2002 Mou et al. ..... 347/86
6,460,985 B1 10/2002 Olsen et al.
6,464,346 B1 10/2002 Otis, Jr. et al.
6,523,579 B1 2/2003 Tham
6,523,946 B1 * 2/2003 Mou et al. ..... 347/86
2001/0028379 A1 10/2001 Mou
2003/0038866 A1 2/2003 Yu

FOREIGN PATENT DOCUMENTS

EP 0 529 880 3/1993
EP 0684136 11/1995
EP 1095781 5/2001

* cited by examiner

*Primary Examiner*—K. Feggins

(57) ABSTRACT

Apparatus and methods for regulating back pressure within an ink reservoir for use in printing systems. Back pressure is regulated using a column of liquid within a trap contained in the ink reservoir. The trap is vented on one side to ambient pressure and to the other side within the body of the ink reservoir.

50 Claims, 7 Drawing Sheets

REGULATION OF BACK PRESSURE WITHIN AN INK RESERVOIR

TECHNICAL FIELD OF THE INVENTION

The present invention relates generally to regulation of back pressure within an ink reservoir without the need for reticulated foam or other filler material of controlled capillary force.

BACKGROUND OF THE INVENTION

Inkjet printing has become an established printing technique and generally involves the controlled delivery of ink drops from an ink containment structure, or reservoir, to a printing surface, or print media.

One type of inkjet printing, known as drop-on-demand printing, employs a pen that has a print head that is responsive to control signals for ejecting drops of ink from the ink reservoir. Drop-on-demand inkjet printers typically use one of two mechanisms for ejecting drops: thermal bubble or piezoelectric pressure wave. The print head of a thermal bubble type pen includes a thin film resistor that is heated to cause sudden vaporization of a small portion of the ink. The rapid expansion of the ink vapor forces a small amount of ink through a print head orifice.

Piezoelectric pressure wave systems use a piezoelectric element that is responsive to a control signal for abruptly compressing a volume of ink in the print head to thereby produce a pressure wave that forces the ink drops through the orifice.

Although conventional drop-on-demand print heads are effective for ejecting or "pumping" ink drops from a pen reservoir, they do not include any mechanism for preventing ink from permeating through the print head when the print head is inactive. Accordingly, drop-on-demand techniques require a slight back pressure at the print head to prevent ink from leaking through an inactive print head.

One prior technique for providing sufficient back pressure at the print head employs a reticulated synthetic foam within the ink reservoir. The capillarity of the foam provides the back pressure necessary for preventing the ink from permeating through the print head whenever the print head is inactive. Fiber matting and closely-spaced sheets of wettable material have also been used to provide a controlled capillary force.

One problem associated with the use of foam for establishing back pressure at the print head is that some of the ink in the reservoir will become trapped in the very small pores of the foam. Specifically, pore size in foam varies throughout the volume of the foam. The very small pores in the foam exert on the ink a correspondingly strong capillarity that cannot be overcome by the pumping effect of a conventional print head. Any amount of ink that remains trapped in the pen reduces the volumetric efficiency of the pen, which efficiency can be quantified as the interior volume of the pen divided by the total volume of the ink that is delivered by the print head. Oftentimes, the retained ink can account for 15–20% of the original ink volume. In addition, such systems may become unreliable at extreme elevation. For example, standard foam-based ink reservoirs may become unusable at elevations above approximately 9000 feet above sea level as the capillary force of the reticulated foam becomes more difficult to overcome at decreasing ambient pressures.

For the reasons stated above, and for other reasons stated below that will become apparent to those skilled in the art upon reading and understanding the present specification, there is a need in the art for alternatives for regulating back pressure within an ink reservoir.

SUMMARY

Apparatus have been described for regulating back pressure within an ink reservoir for use in printing systems. Back pressure is regulated using a column of liquid within a trap contained in the ink reservoir. The trap is vented on one side to ambient pressure and to the other side within the body of the ink reservoir.

Further embodiments of the invention include methods and apparatus of varying scope.

DETAILED DESCRIPTION

In the following detailed description of the present embodiments, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The following detailed description is, therefore, not to be taken in a limiting sense, and the scope of the present invention is defined only by the appended claims and equivalents thereof.

Figure 1:
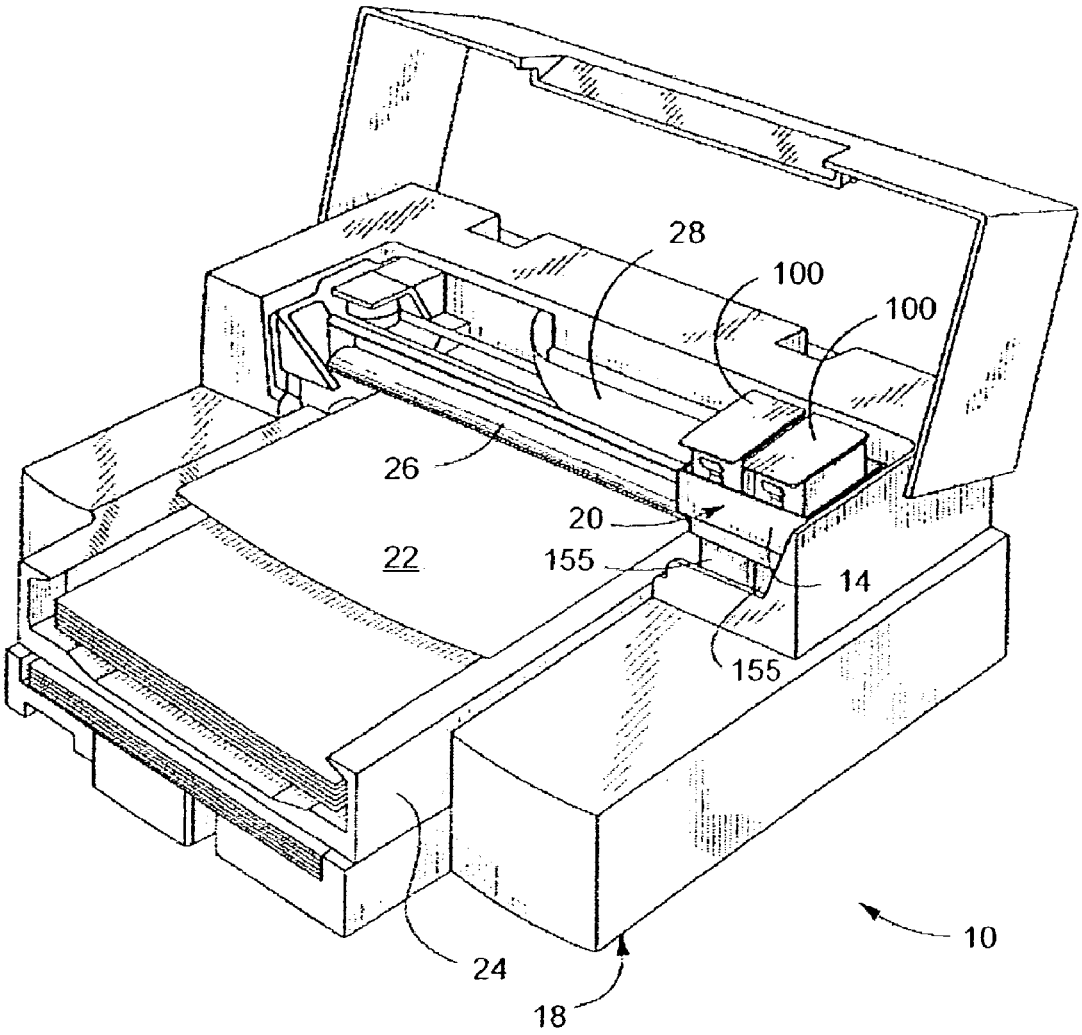
FIG. 1 is a perspective view of a printing system in accordance with one embodiment of the invention.

FIG. 1 is a perspective view of one exemplary embodiment of a printing system 10 shown with its cover open that includes at least one replaceable ink reservoir 100 that is installed in a receiving station 14. At least one of the replaceable ink reservoirs 100 is adapted to provide for regulation of back pressure in accordance with an embodiment of the invention.

In operation, ink is provided from the replaceable ink reservoir 100 to at least one inkjet printhead 155. The inkjet printhead 155 is responsive to activation signals from a printer portion 18 to deposit ink on print media 22. The inkjet printhead 155 may be integral to the replaceable ink reservoir 100 or the ink reservoir 100 may be removably attached to the inkjet printhead 155 when installed in the printing system 10. In either case, each ink reservoir 100 is in flow communication with its printhead 155.

For one embodiment, the replaceable ink reservoir 100, receiving station 14, and inkjet printhead 155 are each part of a scanning carriage that is moved relative to print media 22 to accomplish printing. The printer portion 18 includes a media tray 24 for receiving the print media 22. As the print media 22 is stepped through a print zone, the scanning carriage 20 moves the printhead 155 relative to the print media 22. The printer portion 18 selectively activates the printhead 155 to deposit ink on print media 22 to thereby accomplish printing.

The scanning carriage 20 is moved through the print zone on a scanning mechanism that includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printhead 155 by means of an electrical link such as a ribbon cable 28. The various components for moving a printhead 155 relative to the print media 22, which may include moving one or both of the printhead 155 and print media 22, may be referred to as a printer engine.

It will be recognized that replaceable ink reservoirs 100, often referred to as ink cartridges, may come in a variety of form factors and may be usable in a variety of printing systems including, for example, printers, facsimile (fax) machines, copiers and multifunction devices. Similarly, the ink reservoirs 100 may contain a single ink color, e.g., cyan, magenta, yellow or black, or they may be compartmentalized to contain more than one ink color.

Figure 2A:
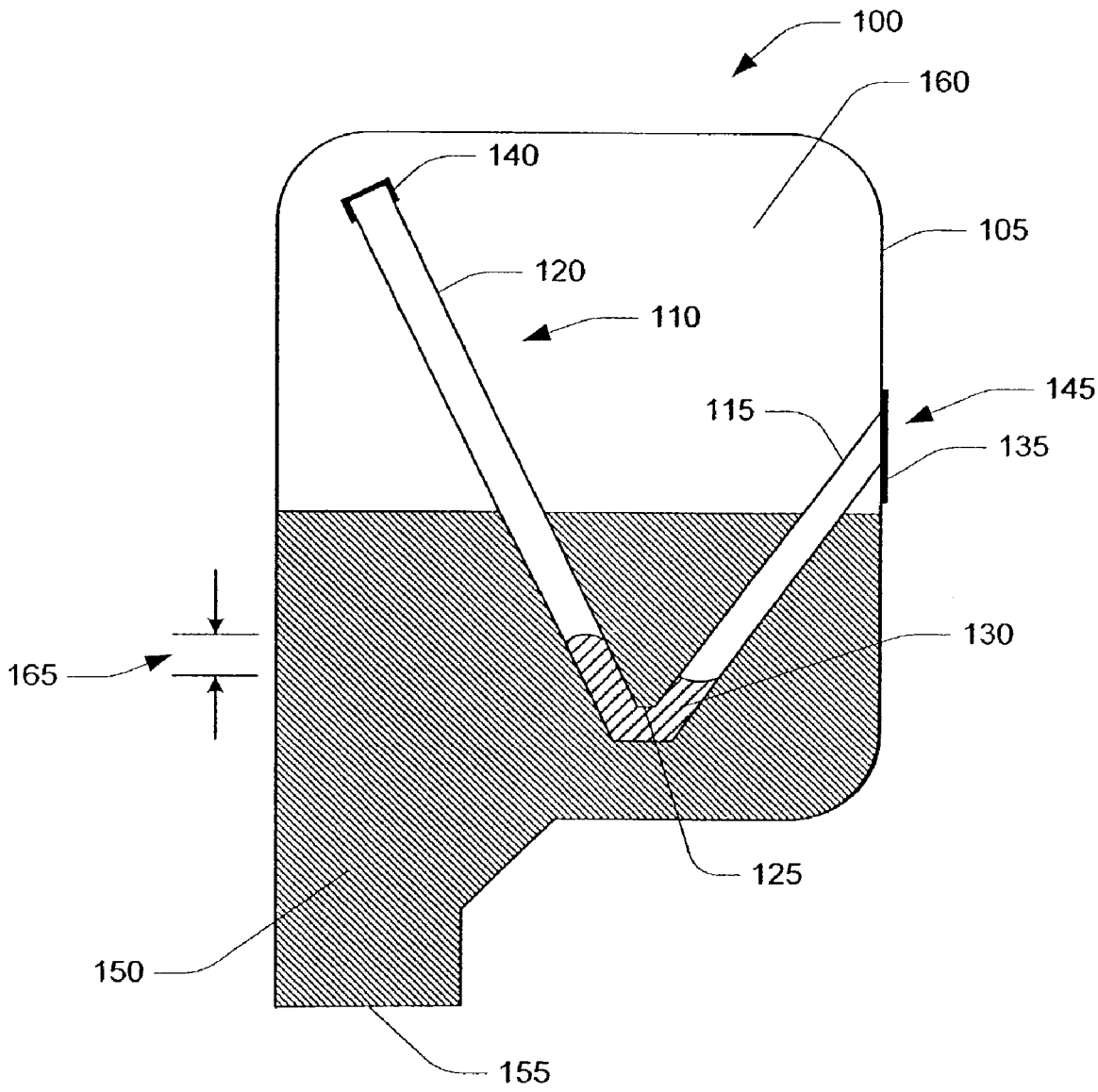
FIGS. 2A–2B are cross-sectional views of an ink reservoir in accordance with an embodiment on the invention depicting operation of the ink reservoir.
Figure 2B:
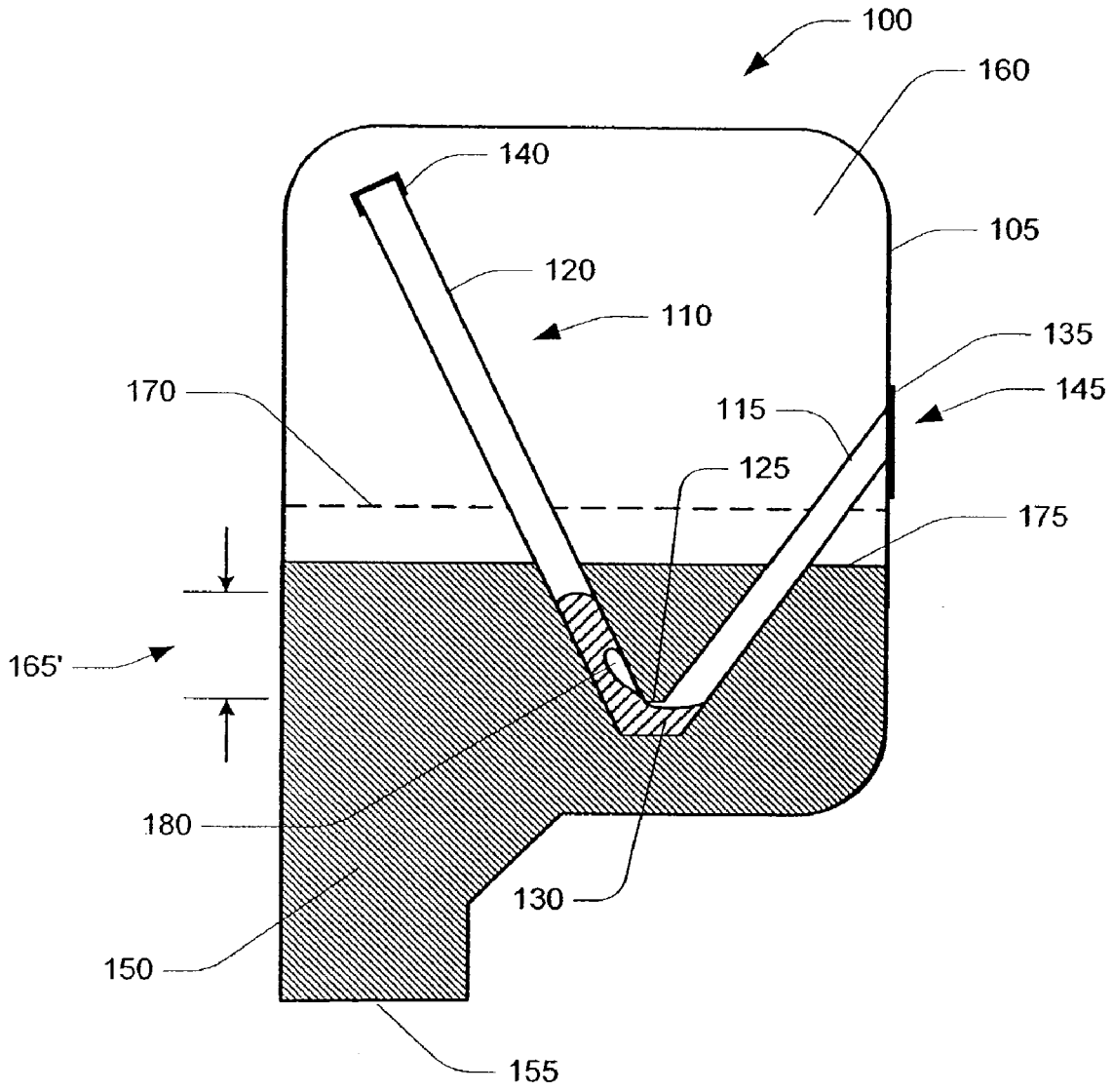

FIGS. 2A–2B are cross-sectional views of an ink reservoir 100 in accordance with one embodiment of the invention. The ink reservoir 100 includes a body 105. The volume within the body 105 is adapted to contain ink. The area enclosed by body 105 may represent the cross-section of a one-color ink reservoir or an individual chamber of a multi-color ink reservoir, with each chamber having its own trap for regulating the pressure within that chamber. Thus, the various embodiments include one-color and multi-color ink reservoirs.

The body 105 contains a trap 10 for the regulation of pressure within the body 105. The trap 110 includes a first portion or leg 115 adjacent a second portion or leg 120 on opposing sides of a nadir or low point 125. The first leg 115 and second leg 120 are in flow communication with each other through the low point 125.

The trap 110 contains a fluid 130. Although the legs 115 and 120 are depicted in FIGS. 2A–2B as diverging from the low point 125, they could also be converging or substantially parallel. Similarly, although the legs 115 and 120 are depicted to be substantially linear, they could also take on a curved, spiral or other configuration provided that each leg 115 and 120 has at least some portion extending vertically above the low point 125 when the ink reservoir 100 is installed for use within a printing system.

The first leg 115 of the trap 110 is vented from the body 105 at vent hole 145. The trap 110 should include a cover, check-valve, flow restrictor or other means to avoid, or at least restrict, loss of the fluid 130 through the vent hole 145. Porous membranes have been commonly used to vent bodies of ink reservoirs utilizing reticulated foam or other capillary members, so this technology is well understood for permitting air permeation while restricting fluid loss. Therefore, for one embodiment, the vent hole 145 is covered by an air-permeable membrane 135. Similarly, the trap 110 should include some means to restrict loss of the fluid 130 into the body 105 and to restrict entry of the ink 150 into the trap 110. Accordingly, for one embodiment, the second leg 120 of the trap 110 is covered by an air-permeable membrane 140. It is noted that cover 135 is exposed to a different environment than the cover 140. Accordingly, differing membrane types or thicknesses may be used to provide the desired performance characteristics of allowing air permeation while restricting flow of the fluid 130 and/or the ink 150. Common membranes include a variety of expanded polytetrafluoroethylenes (PTFE).

Prior to operation, the ink reservoir 100 would be partially filled with ink 150. Ink reservoirs utilizing reticulated foam or other capillary members are generally filled to only 50–70% of the volume of the body 105. Because these types of ink reservoirs are vented directly to the atmosphere, the capillary member is generally not fully wetted in order to avoid clogging of the vent membrane if the ink reservoir were to be turned upside down. However, the ink 150 in the ink reservoir 100 is separated from the membrane 135 there is insignificant risk that ink will dry on and clog the membrane 135 regardless of the orientation of the ink reservoir 100. Therefore, the body 105 may be filled with ink 150 more completely. For one embodiment, the body 105 is filled with ink 150 until the level is just below the membrane 140 when the ink reservoir 100 is installed in a printing system.

After filling the ink reservoir 100 with ink 150, a back pressure is created by removing air or other gas from the head space 160 of the body 105 as is common with ink reservoirs of the capillary force type. In this process, the pressure within the body 105 is made to be less than atmospheric pressure. Because the pressure within the body 105 is less than atmospheric, the fluid 130 will not be level on both sides of the low point 125. The pressure differential between the inside and outside of the body 105 will be represented by the height differential 165 between the columns of fluid 130 in the first leg 115 and the second leg 120 of the trap 110.

As depicted in FIG. 2B, during operation, ink 150 will be expelled from the integral printhead 155, or otherwise delivered from the body 105 to a separate printhead, thus causing the level of the ink 150 to drop from a first level 170 to a second level 175. This will result in an increase in volume of the head space 160, thus resulting in a further drop of pressure within the body 105. This further drop in pressure will cause the level of the fluid 130 in the first leg 115 to drop while the level of the fluid 130 in the second leg 120 correspondingly rises, thus increasing the height differential between the columns of fluid 130. Continuing decreases in pressure in the head space 160 will result in the height differential between the columns of clued 130 reaching a maximum level 165'. At this level, the fluid 130 in the first leg 115 drops to the level of the low point 125. At that point, further decreases in pressure will cause air entering the vent hole 145 to pass beyond the low point 125 in the form of bubbles 180 that will pass through the membrane 140 into the head space 160, thus resulting in an increase in the pressure within the head space 160. The pressure within the head space 160 will then tend to remain regulated approximately at an internal pressure necessary to maintain the height differential of the columns of fluid 130 at its maximum level 165' while the ink reservoir 100 is oriented for use. It is recognized that the pressure will tend to oscillate around this equilibrium pressure as bubbles 180 are formed and released into the head space 160.

A cross-sectional geometry of the trap 110 can be varied such that the invention is not limited to a single geometry. Similarly, it is not required that the geometry used for the first leg 115 be the same as the geometry of the second leg 120. Common geometries might include circular, elliptical, rectangular, triangular and other curvilinear or polygonal geometries. However, it is expected that traps 110 of circular tubular members are generally easier to manufacture and will contribute to formation of the bubbles 180.

The cross-sectional area of the trap 110 should be sufficiently large to allow for the formation of the bubbles 180 at the low point 125 and to permit passage of the bubbles 180 through the second leg 120. However, to increase the ink efficiency of the ink reservoir 100, it will be desirable to minimize the amount of space taken up by the trap 110 within the body 105. While the ease of dissipating the bubbles 180 will depend to an extent on the surface tension of the fluid 130, for one embodiment, the second leg 120 has a circular cross-section and an inside diameter of approximately 3–5 mm.

The amount of fluid 130 contained in the trap 110 should be chosen such that the maximum level 165' is reached when the pressure within the head space 160 is equal to a maximum desired back pressure. For one embodiment, the fluid 130 has a specific gravity greater than a specific gravity of the ink 150. This can result in fewer corrections of pressure within the body 105 as the level of fluid 130 will change at a slower rate than changes in the level of ink 150.

Inks are often water-based inks having specific gravities approximately equal to 1. For one embodiment, the fluid 130 is a saline solution, facilitating specific gravities in excess of 1. A surfactant may be added to the saline solution to reduce the surface tension, thus requiring less force to form bubbles 180. For another embodiment, the fluid 130 is a perfluorocarbon liquid. Such fluorocarbon liquids are commonly used in the testing and manufacture of electronic components, such as the Fluorinert™ electronic liquids available from 3M Company, St. Paul, Minn., USA. These perfluorocarbon liquids have relatively low surface tension and specific gravities approximately 75% above that of common inks.

Figure 3:
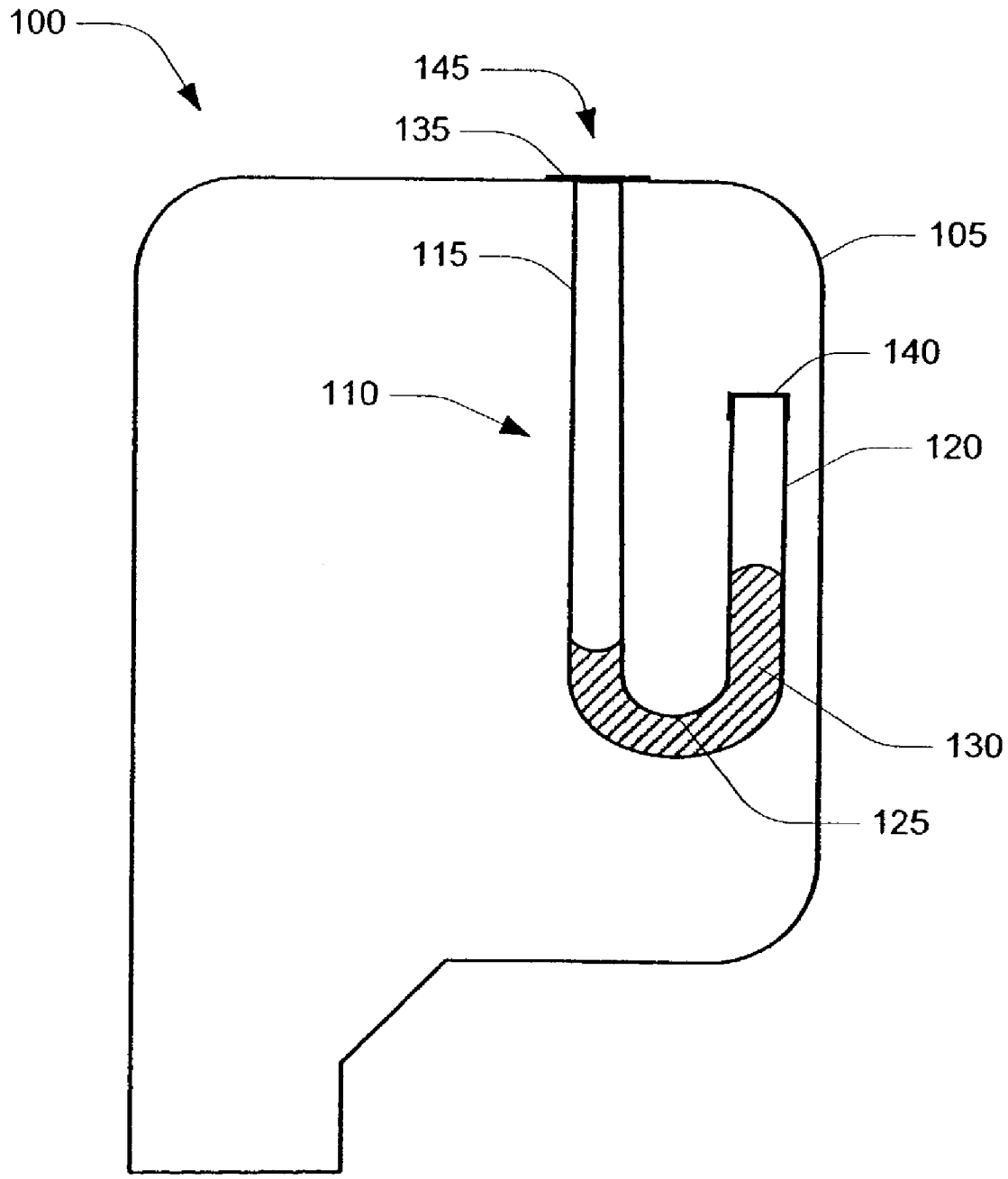
FIGS. 3–6 are cross-sectional views of ink reservoirs in accordance with further embodiments of the invention.
Figure 4:
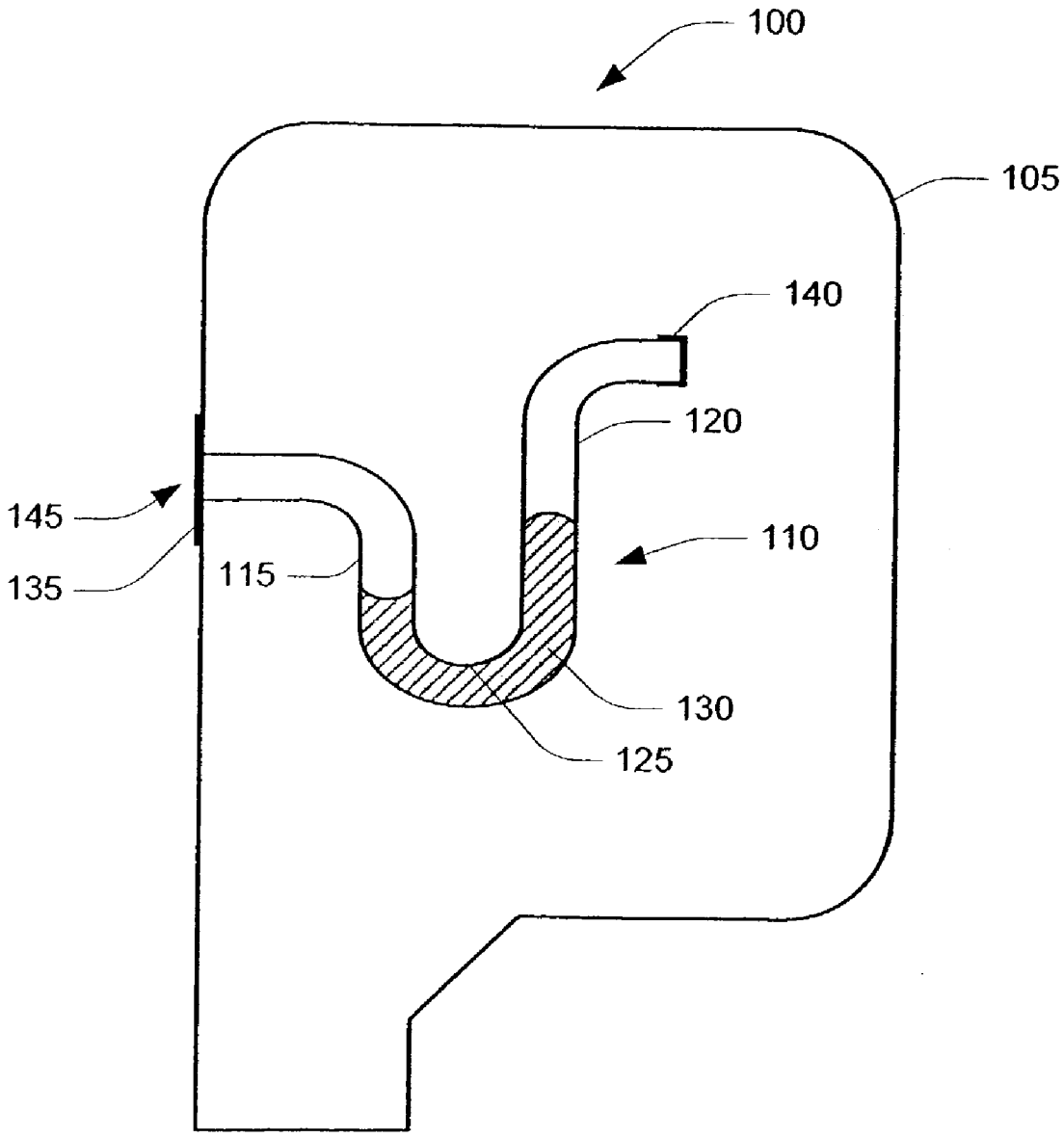
Figure 5:
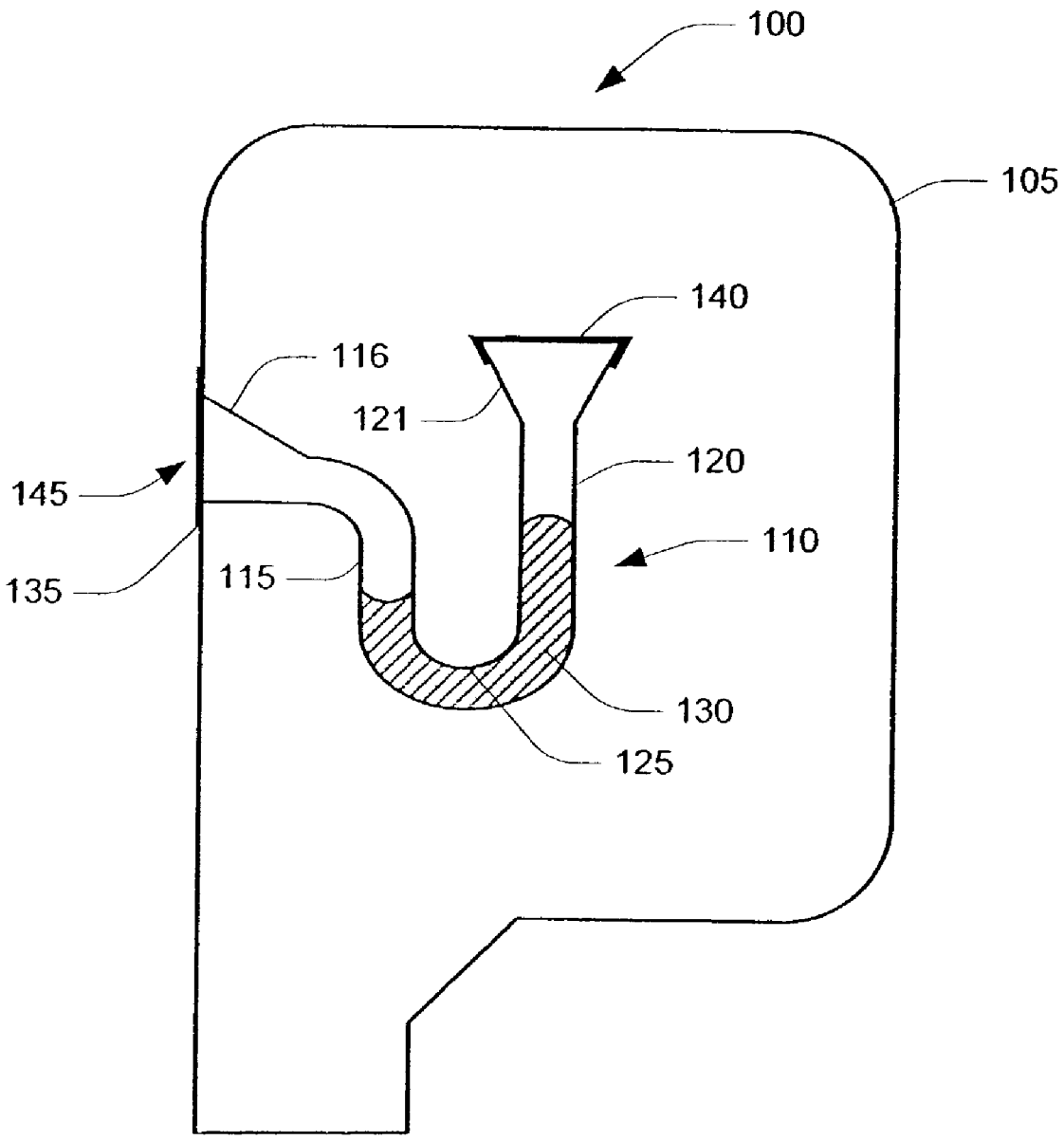

While the trap 110 depicted in FIGS. 2A–2B is essentially a V-shaped tube, other configurations are also possible in accordance with various embodiments of the invention as noted earlier. Similarly, while the vent hole 145 depicted in FIGS. 2A–2B is located on a back side of the body 105, the vent hole 145 can be located virtually anywhere on the body 105 provided appropriate changes are made to the shape of the trap 110. FIGS. 3–5 depict alternate embodiments of the invention. Additional configurations will be apparent to those skilled in the art upon reading the specification and viewing the accompanying figures. However, simple V-shaped or U-shaped tubes are expected to be generally more efficient in terms of the amount of fluid 130 required to maintain a given desired back pressure and of the amount of space taken up by the trap 110 within the body 105.

FIG. 3 is a cross-sectional view of an ink reservoir 100 in accordance with another embodiment of the invention. In the embodiment of FIG. 3, the vent hole 145 is located on a top of the body 105. In addition, while the legs 115 and 120 of FIG. 2 were diverging, the legs 115 and 120 of FIG. 3 are substantially parallel and vertical relative to the body 105. FIG. 4 is a cross-sectional view of an ink reservoir 100 in accordance with yet another embodiment of the invention. In the embodiment of FIG. 4, the vent hole 145 is located on a front of the body 105. FIG. 5 is a cross-section view of an ink reservoir 100 in accordance with a further embodiment of the invention. In the embodiment of FIG. 5, the legs 115 and 120 include flared ends 116 and 121, respectively. The flared ends 116 and 121 facilitate a higher surface area for the membranes 135 and 140, respectively. A higher surface area membrane provides for improved air flow, i.e., reduced restriction, into and out of the trap 110, thus improving the response time of the pressure regulation and reducing the risk of plugging without significantly impacting the volume of body 105 available for ink containment. Although funnel shaped flares are depicted for ends 116 and 121, it is noted that any geometry providing for a larger cross-sectional area of the ends of the trap 110 relative to other portions of the trap 110, especially those portions of the trap 110 containing fluid 130, are also acceptable.

Figure 6:
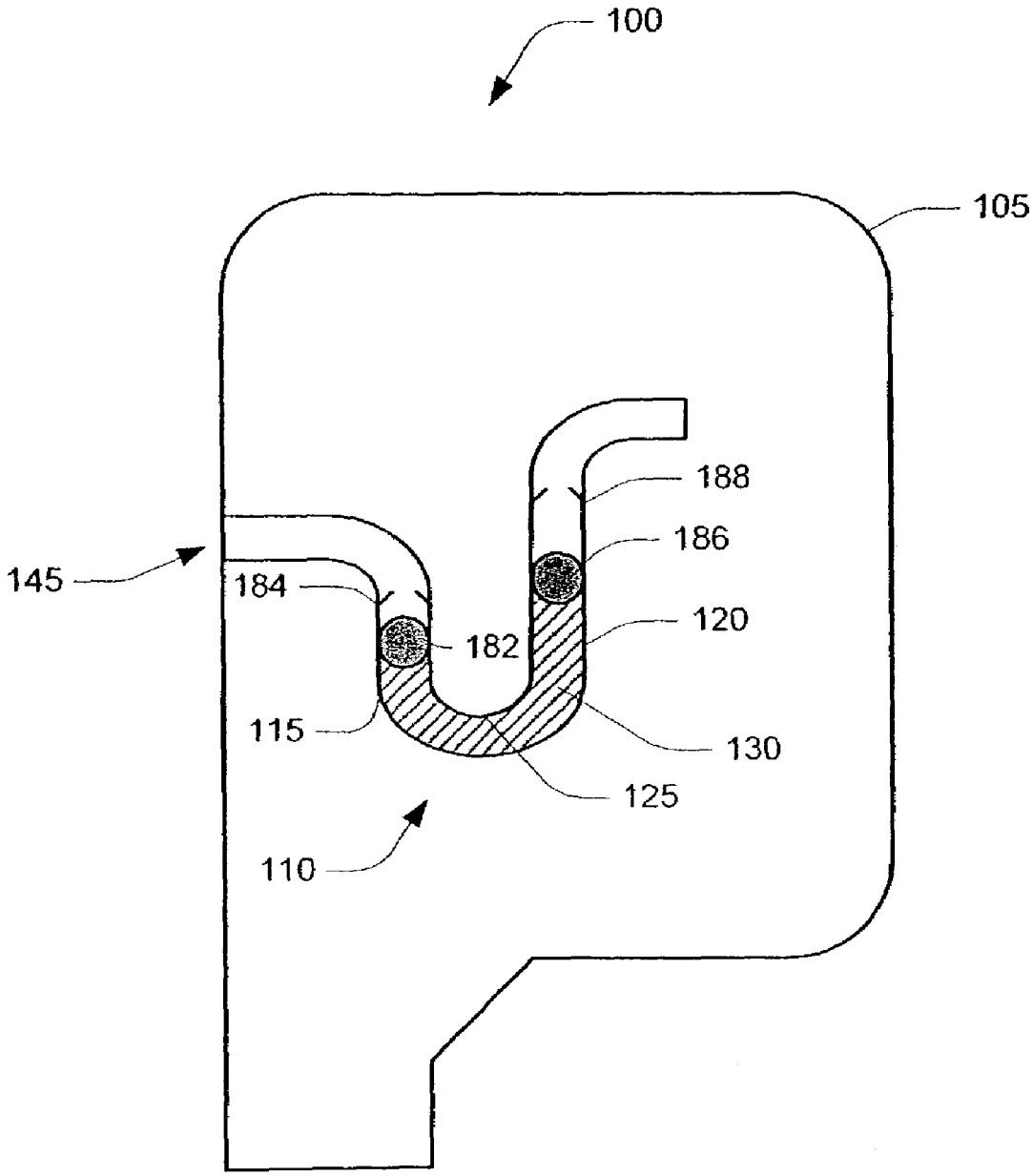

FIG. 6 is a cross-sectional view of an ink reservoir 100 in accordance with still another embodiment of the invention. In the embodiment of FIG. 6, alternative means for avoiding or inhibiting loss of the fluid 130 are used. A first check valve of a ball 182 and a seat 184 are included in the first leg 115 of the trap 110 to block flow of fluid 130 from exiting the vent hole 145. A second check valve of a ball 186 and a seat 188 are included in the second leg 115 of the trap 110 to block flow of fluid 130 from entering the body 105. The check valves may be used in place of, or in addition to, the membranes of other embodiments.

Because ink reservoirs utilizing filler material of controlled capillary force rely on the hydrostatic pressure of the ink to permit flow to the printhead, a substantial amount of ink is required to overcome the capillary force. This often results in about 15–20% of the original ink volume remaining in the ink reservoir when flow is no longer possible. Ink reservoirs in accordance with embodiments of the invention have been shown to result in ink delivery in excess of 95% of the original volume. In addition, such ink reservoirs have been shown to operate at atmospheric pressures equivalent to an elevation in excess of 25000 feet above sea level.

CONCLUSION

Apparatus and methods have been described for regulating back pressure within an ink reservoir for use in printing systems. Back pressure is regulated using a column of liquid within a trap contained in the ink reservoir. The trap is vented on one side to ambient pressure and to the other side within the body of the ink reservoir.

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any such adaptations or variations of the invention. It is manifestly intended that this invention be limited only by the following claims and equivalents thereof.

What is claimed is:

1. An ink reservoir for use in a printing system, comprising:

a body for containing ink;

a trap contained within the body and enclosing a fluid, wherein the trap comprises:

a low point;

a first leg extending from one side of the low point, with at least some portion of the first leg extending vertically above the low point when the ink reservoir is installed for use in the printing system;

a second leg extending from an opposing side of the low point, with at least some portion of the second let extending vertically above the low point when the ink reservoir is installed for use in the printing system;

wherein the first leg is vented outside the body; and wherein the second leg is vented inside the body.

2. The ink reservoir of claim 1, wherein the first leg is vented outside the body through an air-permeable membrane.

3. The ink reservoir of claim 2, wherein the air-permeable membrane is located on an end of the first leg and the end of the first leg has a cross-sectional area greater than a cross-sectional area of portions of the first leg enclosing the fluid.

4. The ink reservoir of claim 3, wherein the end of the first leg is flared.

5. The ink reservoir of claim 1, wherein the second leg is vented inside the body through an air-permeable membrane.

6. The ink reservoir of claim 5, wherein the air-permeable membrane is located on an end of the second leg and the end of the second leg has a cross-sectional area greater than a cross-sectional area of portions of the second leg enclosing the fluid.

7. The ink reservoir of claim 6, wherein the end of the second leg is flared.

8. The ink reservoir of claim 1, wherein the first leg comprises a check-valve for restricting flow of the fluid out of the first leg.

9. The ink reservoir of claim 1, wherein the second leg comprises a check-valve for restricting flow of the fluid out of the second leg.

10. The ink reservoir of claim 1, wherein the fluid has a specific gravity greater than that of the ink.

11. The ink reservoir of claim 10, wherein the ink is a water-based ink and the fluid is a saline solution.

12. The ink reservoir of claim 11, wherein the saline solution further comprises a surfactant.

13. The ink reservoir of claim 10, wherein the fluid is a perfluorocarbon liquid.

14. The ink reservoir of claim 1, wherein the first leg, low point and second leg form a substantially V-shaped or U-shaped section.

15. The ink reservoir of claim 1, wherein the trap encloses a volume of the fluid such that when a desired back pressure is reached within the body while the ink reservoir has an orientation approximating its orientation during use, a column of the fluid in the first leg will be approximately equal in level with the low point.

16. The ink reservoir of claim 1, further comprising:

a printhead integral to the body for delivering the ink to a print medium.

17. The ink reservoir of claim 1, wherein the body is adapted to contain a second ink.

18. An ink reservoir for use in a printing system, comprising:

means for containing ink; and means for regulating pressure within the means for containing ink;

wherein the means for regulating pressure utilizes a trapped volume of fluid separated from the ink.

19. The ink reservoir of claim 18, further comprising:

means for restricting flow of the trapped volume of fluid from the means for regulating pressure out of the ink reservoir;

means for restricting flow of the trapped volume of fluid from the means for regulating pressure into the ink reservoir;

means for allowing air permeation into the means for regulating pressure from outside the ink reservoir; and means for allowing air permeation out of the means for regulating pressure into the ink reservoir.

20. The ink reservoir of claim 19, further comprising:

means for delivering the ink to a print medium.

21. The ink reservoir of claim 19, further comprising:

means for delivering the ink to a printhead.

22. The ink reservoir of claim 19, further comprising:

means for reducing restriction of air flow out of the means for regulating pressure into the ink reservoir.

23. The ink reservoir of claim 22, further comprising:

means for reducing restriction of air flow into the means for regulating pressure from outside the ink reservoir.

24. An ink reservoir for use in a printing system, comprising:

a body containing a volume of ink;

a trap within the body having a first leg vented to an ambient pressure, a second leg vented within the body and a low point interposed between the first and second legs;

a volume of fluid within the trap;

a first air-permeable membrane covering an end of the first leg vented to the ambient pressure; and a second air-permeable membrane covering an end of the second leg vented within the body.

25. The ink reservoir of claim 24, wherein the air-permeable membranes comprise expanded polytetrafluoroethylene.

26. The ink reservoir of claim 25, wherein the expanded polytetrafluoroethylene of the first air-permeable membrane differs from the expanded polytetrafluoroethylene of the second air-permeable membrane.

27. The ink reservoir of claim 24, wherein the volume of fluid is chosen to permit entry of air into the body through the second leg when the body has an orientation assumed during operation and a pressure differential between the body and an ambient pressure reaches a desired operating back pressure.

28. The ink reservoir of claim 24, further comprising a printhead integral to the body.

29. An ink reservoir for use in a printing system, comprising:

a body containing a volume of ink;

a trap within the body having a first leg vented to an ambient pressure, a second leg vented within the body and a low point interposed between the first and second legs;

a volume of fluid within the trap;

a first air-permeable membrane covering an end of the first leg vented to the ambient pressure; and a second air-permeable membrane covering an end of the second leg vented within the body;

wherein the end of the first leg has a cross-sectional area greater than a cross-sectional area of the trap at the low point; and wherein the end of the second leg has a cross-sectional area greater than the cross-sectional area of the trap at the low point.

30. The ink reservoir of claim 29, wherein the air-permeable membranes comprise expanded polytetrafluoroethylene.

31. The ink reservoir of claim 29, wherein the volume of fluid is chosen to permit entry of air into the body through the second leg when the body has an orientation assumed during operation and a pressure differential between the body and an ambient pressure reaches a desired operating back pressure.

32. The ink reservoir of claim 29, further comprising a printhead integral to the body.

33. An ink reservoir for use in a printing system, comprising:

a body for containing a volume of ink;

a first tube contained within the body and having a first end vented within the body;

a second tube contained within the body and having a first end vented outside the body, wherein the second tube is in flow communication with the first tube through a low point;

a volume of fluid contained within at least one of the first and second tubes;

a first membrane covering the first end of the first tube, wherein the first membrane is adapted to allow air permeation into the first tube and to restrict flow of the fluid out of the first tube; and a second membrane covering the first end of the second tube wherein the second membrane is adapted to allow air permeation out of the second tube and to restrict flow of the volume of ink into the second tube and restrict flow of the fluid out of the second tube.

34. The ink reservoir of claim 33, wherein the first and second tubes have substantially circular cross-sections.

35. The ink reservoir of claim 33, wherein the first tube has the same geometry as the second tube.

36. The ink reservoir of claim 33, wherein the first and second tubes diverge from a low point.

37. The ink reservoir of claim 36, wherein the first and second tubes are each substantially linear.

38. An ink reservoir for use in a printing system, comprising:

a body having a first chamber for containing a first volume of ink and a second chamber for containing a second volume of ink, wherein each chamber comprises:

a trap contained within that chamber and having a first end vented outside the body and a second end vented within that chamber, wherein the trap encloses a volume of fluid;

a first membrane covering the first end of the trap, wherein the first membrane is adapted to allow air permeation into the trap and to restrict flow of the fluid out of the trap; and a second membrane covering the first end of the trap, wherein the second membrane is adapted to allow air permeation out of the trap and to restrict flow of the volume of ink into the trap and restrict flow of the fluid out of the trap.

39. The ink reservoir of claim 38, wherein the fluid has a specific gravity greater than that of the ink of the first volume and greater than that of the ink of the second volume.

40. The ink reservoir of claim 39, wherein each ink is a water-based ink and the fluid is a saline solution.

41. The ink reservoir of claim 40, wherein the saline solution further comprises a surfactant.

42. The ink reservoir of claim 39, wherein the fluid is a perfluorocarbon liquid.

43. The ink reservoir of claim 38, wherein each trap forms a substantially V-shaped or U-shaped section.

44. The ink reservoir of claim 38, wherein each trap encloses a volume of the fluid such that when a desired back pressure is reached within the corresponding chamber while the ink reservoir has an orientation approximating its orientation during use, air will be permitted to escape into that chamber through the trap.

45. The ink reservoir of claim 38, further comprising:

a printhead integral to the body for delivering the first and second volumes of ink to a print medium.

46. A method of maintaining back pressure in a printer ink reservoir, the ink reservoir having an interior volume for retaining ink, the method comprising:

providing air communication between a first leg of a fluid trap and the interior volume;

venting a second leg of the fluid trap to ambient pressure; and maintaining a volume of fluid in a low point of the fluid trap.

47. The method of claim 46, further comprising:

selecting the volume of fluid such that a level of the fluid in the second leg reaches the low point when a maximum desired back pressure is reached within the interior volume.

48. The method of claim 47, further comprising:

relieving back pressure within the interior volume by bubbling air past the low point after the level of the fluid in the second leg reaches the low point.

49. A method of maintaining back pressure in an ink reservoir for use in a printing system, the ink reservoir having a body for containing ink, the method comprising:

maintaining a volume of fluid in a low point of a fluid trap while venting a first leg of the fluid trap to an interior of the body and venting a second leg of the fluid trap to ambient pressure;

expelling ink from the body of the ink reservoir, thereby increasing back pressure within the body;

releasing air into the body of the ink reservoir through the fluid trap as the increasing back pressure brings a level of a column of the fluid in the second leg to a level of the low point; and alternately expelling ink from the body of the ink reservoir and releasing air into the body to maintain the back pressure within the body oscillating around an equilibrium pressure.

50. The method of claim 49, further comprising:

selecting the volume of fluid such that the equilibrium pressure is approximately equal to a maximum desired back pressure within the body.

* * * * *

UNITED STATES PATENT AND TRADEMARK OFFICE

CERTIFICATE OF CORRECTION

PATENT NO. : 7,040,743 B2
APPLICATION NO. : 10/423360
DATED : May 9, 2006
INVENTOR(S) : Miguel A. Acosta et al.

It is certified that error appears in the above-identified patent and that said Letters Patent is hereby corrected as shown below:

In column 3, line 34, delete “10” and insert -- 110 --, therefor.

In column 6, line 57, in Claim 1, after “system;” insert -- and --.

In column 6, line 59, in Claim 1, delete “let” and insert -- leg --, therefor.

Signed and Sealed this

Thirty-first Day of March, 2009

John Doll

JOHN DOLL
*Acting Director of the United States Patent and Trademark Office*